US005667223A

United States Patent [19]

Yedid

[11] Patent Number: 5,667,223

[45] Date of Patent: Sep. 16, 1997

[54] STRATEGY BOARD GAME AND METHOD OF PLAY THEREOF

[76] Inventor: Avraham Yedid, 5 Karmon Street, Jerusalem 96308, Israel

[21] Appl. No.: 701,324

[22] Filed: Aug. 22, 1996

[51] Int. Cl.[6] ..... A63F 3/02

[52] U.S. Cl. ..... 273/261

[58] Field of Search ..... 273/260, 261, 273/248, 249, 255, 262

[56] References Cited

U.S. PATENT DOCUMENTS

| | | | |
|---|---|---|---|
| D. 31,815 | 11/1899 | Eveleth | 273/261 X |
| 529,582 | 11/1894 | Beaman | 273/261 |
| 3,730,527 | 5/1973 | Nelson | 273/261 X |
| 3,990,706 | 11/1976 | Wong | 273/260 |
| 4,256,309 | 3/1981 | McQuillan | 273/261 X |
| 5,257,787 | 11/1993 | Miccio | 273/260 |
| 5,280,913 | 1/1994 | Sirk | 273/261 |

FOREIGN PATENT DOCUMENTS

| | | | |
|---|---|---|---|
| 485536 | 5/1938 | United Kingdom | 273/261 |

*Primary Examiner*—William E. Stoll
*Attorney, Agent, or Firm*—Howard Zaretsky

[57] ABSTRACT

A novel strategy board game and method of play thereof is disclosed. The board game is played on a board having a playing surface arranged as a plurality of squares. The board is arranged as nine rows by five columns of squares. The squares alternate light and dark in checkerboard style. Two players each start a primary playing piece and four guards. The guards operate in pairs, with each player having two pair, and function to both protect a player's primary playing piece and attack the opponent's playing pieces. In the center square of the board sits the crown representing the princess. The object of the game is for a player to be the first to reach the princess with his/her primary playing piece. Players utilize their playing pieces to put squeezes on their opponent's playing pieces. A squeeze functions to force a player to move the squeezed piece. A squeezed playing piece can be rescued by their partner playing piece by raising the squeeze to a royal squeeze. Players rely on their skill and strategy to win, as chance or luck is not an element of the game.

12 Claims, 5 Drawing Sheets

STRATEGY BOARD GAME AND METHOD OF PLAY THEREOF

FIELD OF THE INVENTION

The present invention relates to board games and more particularly relates to a strategy board game played on a checker style board with playing pieces.

BACKGROUND OF THE INVENTION

Strategy board games are well known in the art. There are numerous board games that include a playing board and a plurality of playing pieces. However the majority of these board games involve some element of luck in their method of play. For some games, the only way to win is by luck. Other games combine, in some fashion, luck and strategy. For example, many games include dice in their play. The dice introduce an element of luck. Otherwise experienced players may ultimately lose such a game if they receive enough unlucky throws of the dice.

On the other hand board games exist that rely only on strategy and technique for a player to win. Examples, include checkers and chess. Chess being significantly more complicated to learn how to play and to actually play than checkers. The game of chess involves numerous different complex playing pieces whose movements and abilities require some time to master. In addition, the game quickly becomes complex involving playing piece arrangements and scenarios that are not trivial to analyze. Thus, a player's goal of determining an optimum move is not an easy task when attempting to consider multiple outcomes across multiple levels of play.

In addition, the typical time duration to complete a game of chess is relatively long when compared to other board games. Chess games, depending on the skill of the players, can last anywhere from five minutes to five days or more.

Checkers on the other hand is an order of magnitude simpler to learn and play than chess. Thus, many more people know how to play checkers than know how to play chess. In addition, very high skill levels are not required to become an average checkers player. The typical time duration for checker games is also shorter by an order of magnitude. Thus, people pressed for time may reluctantly choose to entertain themselves by playing a quick game of checkers over a game of chess, despite the lower skill level or challenge required to win at checkers.

SUMMARY OF THE INVENTION

Accordingly, it is an object of the present invention to provide a board game and playing pieces which are used to play a game of strategy for the entertainment of the players and spectators.

It is another object of the present invention to provide a game of strategy which is playable by two players.

Another object of the present invention is to provide a game of strategy whose rules of play are relatively simple to learn and which can be mastered in a relatively short time.

Yet another object of the present invention is to provide a two player game of strategy wherein a typical game can be completed in a reasonable period of time.

The present invention discloses a novel strategy board game and method of play thereof. The board game is played on a board having a playing surface arranged as a plurality of squares. The board is arranged as nine rows by five columns of squares. The squares alternate light dark in checkerboard style. Two players each start with a primary playing piece and four guards called secondary playing pieces. The guards operate in pairs, with each player having two pair, and function to both protect a player's primary playing piece and attack the opponent's playing pieces. In the center square, called the conquest square, of the board sits the crown representing the princess. The object of the game is for a player to be the first to reach the princess with his/her primary playing piece. Players utilize their playing pieces to put squeezes on their opponent's playing pieces. A squeeze functions to force a player to move the squeezed piece. A squeezed playing piece can be rescued by their partner playing piece by raising the squeeze to a royal squeeze. Players rely on their skill and strategy to win, as chance or luck is not an element of the game.

There is thus disclosed in accordance with a preferred embodiment of a preferred invention a board game playable by a plurality of players, comprising a game board having a playing surface, the playing surface having a plurality of squares, the plurality of squares alternating light and dark in color and arranged in a checkerboard fashion, the playing surface having a conquest square located in the center thereof, a plurality of primary playing pieces, each primary playing piece visually distinguishable from each other, each player having at least one primary playing piece at the start of the game, a plurality of secondary playing pieces, the plurality of secondary playing pieces visually distinguishable from the plurality of primary playing pieces, each player having an even number of the secondary playing pieces at the start of the game, and wherein the board game being won by a player who first reaches the conquest square with one of the his/her primary playing pieces.

The playing surface of the board game can comprise an odd number of rows and columns. The playing surface of the board game can also comprise an array of the squares arranged nine rows by five columns. The light squares of the playing surface represent corridors of a palace and the dark squares of the playing surface represent rooms of a palace. The conquest square represents a room occupied by a princess.

The plurality of players comprises two players and the plurality of primary pieces comprises two primary playing pieces, one for each the player. The two primary playing pieces comprise a trumpeter and a warlord. The plurality of secondary pieces comprises eight secondary playing pieces, four for each player. The eight secondary playing pieces comprise guards, four for each player.

A player moves his/her primary playing pieces and the secondary playing pieces so as to apply a squeeze to a particular square, the squeeze effective to prevent an opponent playing piece from entering the particular square and, if the particular square is already occupied by the opponent playing piece, forcing the opponent playing piece to move from the particular square.

A player can break the squeeze by moving either a primary or secondary playing piece into position so as to bring the squeeze to a royal squeeze.

One of the plurality of players can be a computer and the board game is adaptable to be played on a computer, wherein the computer operates in referee mode or player mode.

BRIEF DESCRIPTION OF THE DRAWINGS

The invention is herein described, by way of example only, with reference to the accompanying drawings, wherein.

DETAILED DESCRIPTION OF THE INVENTION

The board game of the present invention, generally referenced 40, is played using a plurality playing pieces of which there are four types. The four types of playing pieces are illustrated in FIGS. 1A through 1D. The names given to the various playing pieces are for illustrative purposes only. Applying different names to the playing pieces does not effect the scope of the present invention. In addition, the principles of play of the board game of the present invention are the same regardless of the shape or appearance given to the playing pieces.

In FIGS. 1A through 1D, an illustration of each type of playing piece is given along with a representative symbol. The representative symbol is used in subsequent Figures to help illustrate the principles of play of the board game of the present invention. The symbols serve to reduce unnecessary confusion in the diagrams of the playing board depicting various arrangements of the playing pieces. A letter or group of letters inside a circle are used to uniquely identify each playing piece. Playing pieces can be referred to either by their illustrative reference or their respective symbol references.

The Game Board and Playing Pieces

Figure 1A:
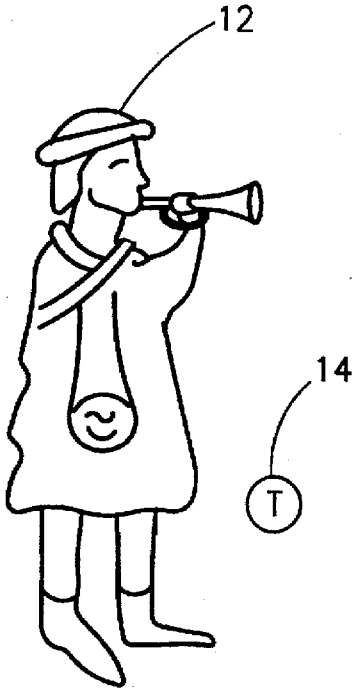
FIG. 1A is an illustration of an example of the trumpeter playing piece of the board game of the present invention and its representative symbol.
Figure 1B:
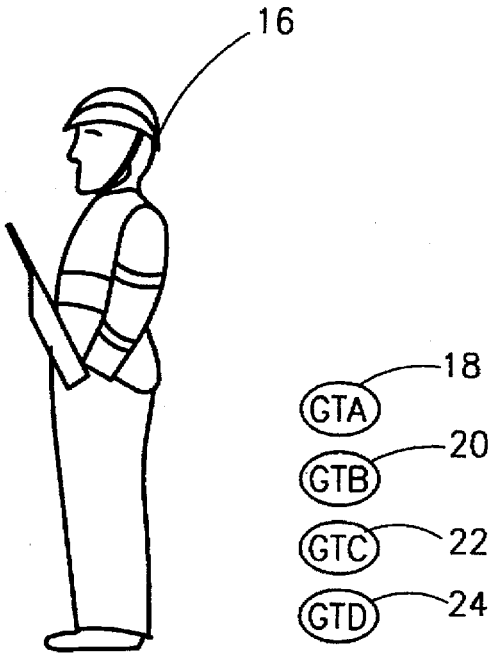
FIG. 1B is an illustration of an example of each of the trumpeter's four guard playing pieces of the board game of the present invention and its representative symbol.

Each player begins the game with at least one primary playing piece and at least four secondary playing pieces. An illustration of an example of a primary playing piece, the trumpeter playing piece 12, of the board game oft he present invention and its representative symbol 14 is shown in FIG. 1A. In a preferred embodiment of the invention, the game is played with each side having only one primary playing piece. The trumpeter is a primary playing piece for one of the players. The trumpeter symbol is represented by the letter 'T' inside a circle. At the beginning of game play, the trumpeter 14 starts out with four secondary playing pieces called guards, referred to as trumpeter guards. An illustration 16 of an example of the trumpeter's four guard playing pieces of the board game of the present invention and their representative unique symbols is shown in FIG. 1B. The four trumpeter's guards are represented by symbols 18, 20, 22, 24. The first guard 18 is represented by the letters 'GTA' within a circle; the second guard 20 is represented by the letters 'GTB' within a circle; the third guard 22 is represented by the letters 'GTC' within a circle; and the forth guard 24 is represented by the letters 'GTD' within a circle. The movement and abilities of the trumpeter and its guards will be described in more detail below.

Figure 1C:
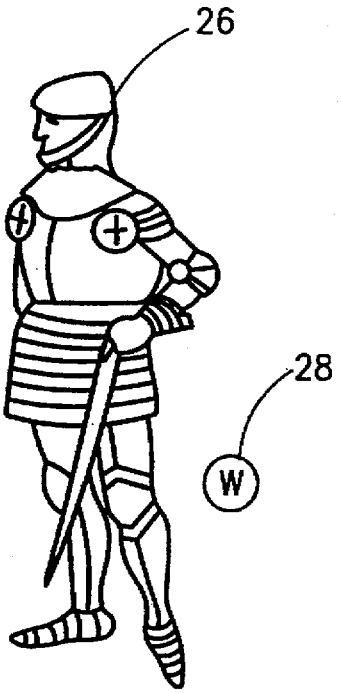
FIG. 1C is an illustration of an example of the war lord playing piece of the board game of the present invention and its representative symbol.
Figure 1D:
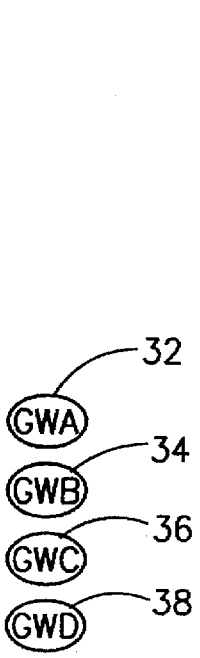
FIG. 1D is an illustration of an example of each of the war lord's four guard playing pieces of the board game of the present invention and its representative symbol.

An example of the other player's primary playing piece is the warlord playing piece 26 of the board game of the present invention. An illustration of the warlord 26 and its representative symbol 28 is shown in FIG. 1C. In a preferred embodiment of the invention, the game is played with only one warlord whose symbol is represented by the letter 'W' inside a circle. At the beginning of game play, the warlord 28 starts out with four secondary playing pieces, called guard playing pieces, and referred to as warlord guards, in like fashion to the trumpeter and its guards. An illustration 30 of an example of the warlord's four guard playing pieces of the board game of the present invention and their representative unique symbols is shown in FIG. 1D. The four warlord's guards are represented by symbols 32, 34, 36, 38. The first guard 32 is represented by the letters 'GWA' within a circle; the second guard 34 is represented by the letters 'GWB' within a circle; the third guard 36 is represented by the letters 'GWC' within a circle; and the forth guard 38 is represented by the letters 'GWD' within a circle. The movement and abilities of the warlord's guards will be described in more detail below.

The primary playing pieces must be visually distinguishable from each other. The secondary playing pieces for any particular playing side preferably are similar to each other but may vary in appearance. The appearance of the secondary playing pieces must be such that they are not confused with the primary playing pieces.

Figure 2:
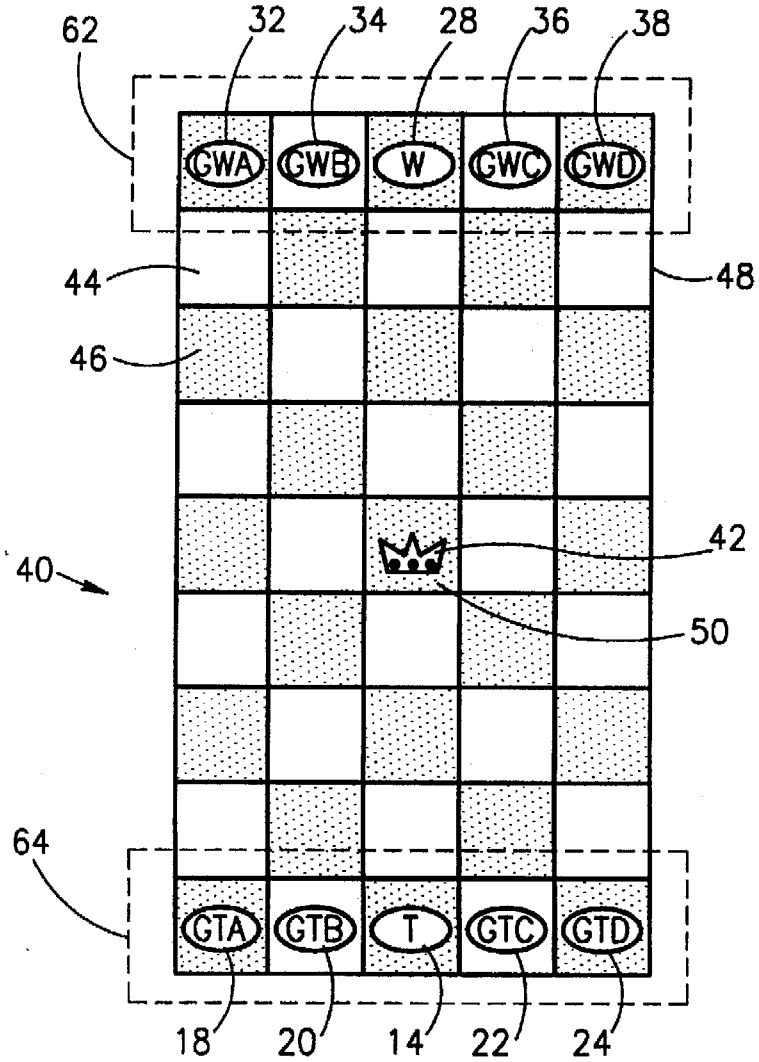
FIG. 2 is a schematic diagram illustrating all the pieces of the board game of the present invention and their positions at the beginning of play.

A schematic diagram illustrating all the pieces of the board game 40 of the present invention and their positions at the beginning of play are shown in FIG. 2. The illustration in FIG. 2 represents a preferred embodiment of the present invention wherein two players each start with one primary playing piece and four secondary playing pieces. The game comprises a flat planar board or member 48 having a playing surface. In a preferred embodiment, the playing surface comprises an array of squares having an odd number of rows and columns. The example illustrated in FIG. 2 has a playing surface comprising 45 squares arranged in a vertically oriented 9 row by 5 column matrix. The playing surface comprise two types of squares: light squares 44 and dark squares 46. The light and dark squares alternate light and dark by both row and column in traditional checkerboard fashion. Suitable light and dark colors include white/black, white/red, red/black or yellow/red, for example. However, any pair of colors is suitable as long as the colors have sufficient contrast against each other and can be easily distinguished during game play.

Start of Game Play

At the beginning of play, each side starts with five playing pieces which are arranged as illustrated in FIG. 2. In the center square 50 of the game board 48 is a crown 42 which represents, for example, a princess. The center square is also called the conquest square. During game play, the princess 42 remains stationary and does not have any powers of her own. Each side's five playing pieces are positioned at the top and bottom rows of the game board. These positions are called home base or base positions. Thus, the top row represents base for the warlord and the bottom row represents base for the trumpeter.

Referring to FIG. 2, the warlord's five playing pieces, referenced by the dashed rectangle 62, are arranged with the guard GWA 32 in the top left corner of the game board, the guard GWB 34 to its right, the warlord W 28 in the center of the top row, the guard GWC 36 to the right of the warlord W and guard GWD 38 in the top right corner square.

Similarly, the trumpeter's five playing pieces, enclosed within dashed rectangle 64, are arranged as shown in FIG. 2. The guard GTA 18 sits in the bottom left corner of the game board, the guard GTB 20 to its right, the trumpeter T 14 in the center of the bottom row, the guard GTC 22 to the right of the trumpeter T and guard GTD 24 in the bottom right corner square.

In a preferred embodiment of the present invention the game board represents a flat sketch of a royal palace. The dark squares represent the rooms of the palace and the light squares represent the corridors within the palace. The conquest square 50 in the center of the game board marked by the royal crown 42 within it represents the princess' room.

Object of the Game

Both the trumpeter and the warlord strive to capture the princess' heart. She happens to like both of them, but only one of them can win her heart. The object of the game is to be the first to reach the princess. The first one to reach the princess will marry her, become the king and win the game. Thus, the object of the game is to be the first player to move his/her primary playing piece (i.e., the trumpeter or the warlord) to the center square 50 (i.e., the conquest square) marked with the crown 42.

Movement of the Playing Pieces

Game play consists of both players taking turns making a single permitted move with one of their playing pieces. After one player makes a move with one of his/her playing pieces, his/her turn terminates and the other player's turn begins.

The permitted movements of each of the four types of playing pieces will now be described in more detail. A schematic diagram illustrating the permitted movements of the playing pieces of the board game of the present invention is shown in FIG. 3.

First, the movement of the guards, both for the trumpeter and the warlord, will be described. As previously described, each side has four guards. The movement of all the guards is identical. The guards are only able to move diagonally. Thus, for each side, one pair of guards moves only across light squares and one pair of guards moves only across dark squares. Within a single turn, a guard may move forward or backward in a diagonal fashion and may perform a single or a double jump move. A guard is not permitted to stand on the square marked by the crown but can pass through it or use it as a mining square in the case of a double jump move. In addition, guards cannot move into a square occupied by another playing piece and cannot jump over other playing pieces.

Figure 3:
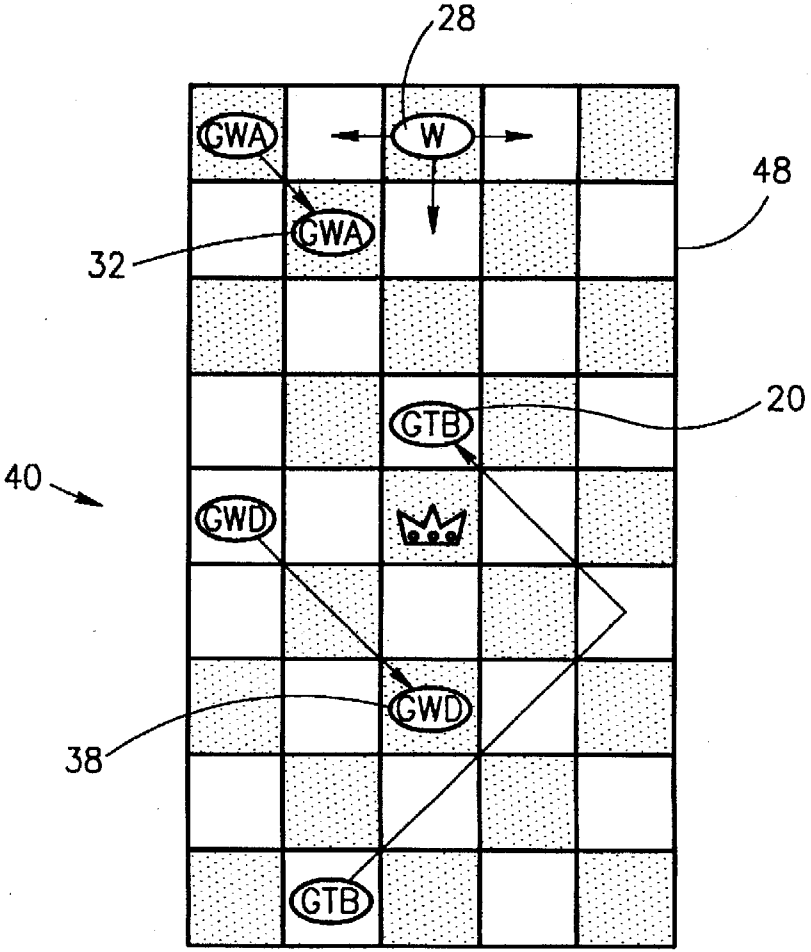
FIG. 3 is a schematic diagram illustrating the permitted movements of the pieces of the board game of the present invention.

With reference to FIG. 3, the guard GWA 32 is shown making a single jump moving a distance of one square to the direction lower right from its original position. The guard GWD 38 is shown making a single jump move a distance of two squares in the direction lower right from its original position. The guard GTB 20 is shown making a double jump move from its original position. Note that each guard makes its move along squares of the same color it started out on.

The movement of both the trumpeter and the warlord (i.e., primary pieces) will now be described in more detail. Both the trumpeter and the warlord move in straight lines only (i.e., no diagonal movement). They can move only one square at a time during a player's turn in any straight line direction (i.e., forward, backward and sideways). Both trumpeter and the warlord cannot move into a square occupied by another playing piece.

With reference to FIG. 3, the permitted movement of a primary playing piece (e.g., the warlord W 28) is shown. If the player representing the warlord is playing at the top portion of the game board then the position of the warlord W shown in FIG. 3 is its starting position. From this position, the warlord can move a single square to the left, right or downward.

The Rules of the Game

The rules of the game will now be described in detail. In a preferred embodiment, the trumpeter is given the first move. Each player, in turn, is permitted to move only one playing piece. For each player, all four guards must leave their base positions (i.e., move at least one square off the base) before the warlord or the trumpeter can be moved.

The function of the guards during game play is to block and prevent the opponent's primary playing piece from reaching the crown. The guards perform their task generally in pairs. On any one side, two guards protect the rooms (i.e., the dark squares) and two guards protect the corridors (i.e., the light squares). A pair of guards can force an opponent out of a particular square or prevent him/her from entering a square by utilizing a technique called a squeeze. A squeeze is a technique used to close in on an opponent's primary playing piece or guard from both sides. A primary piece (i.e., the trumpeter and the warlord) is required to respond to the squeeze just as if it were a guard.

A primary playing piece or a guard that is trapped in a squeeze must immediately move from the squeezed square at the first opportunity. Any other move including a squeeze attack against an opponent is forbidden in addition to going against the principles of the game.

Figure 4:
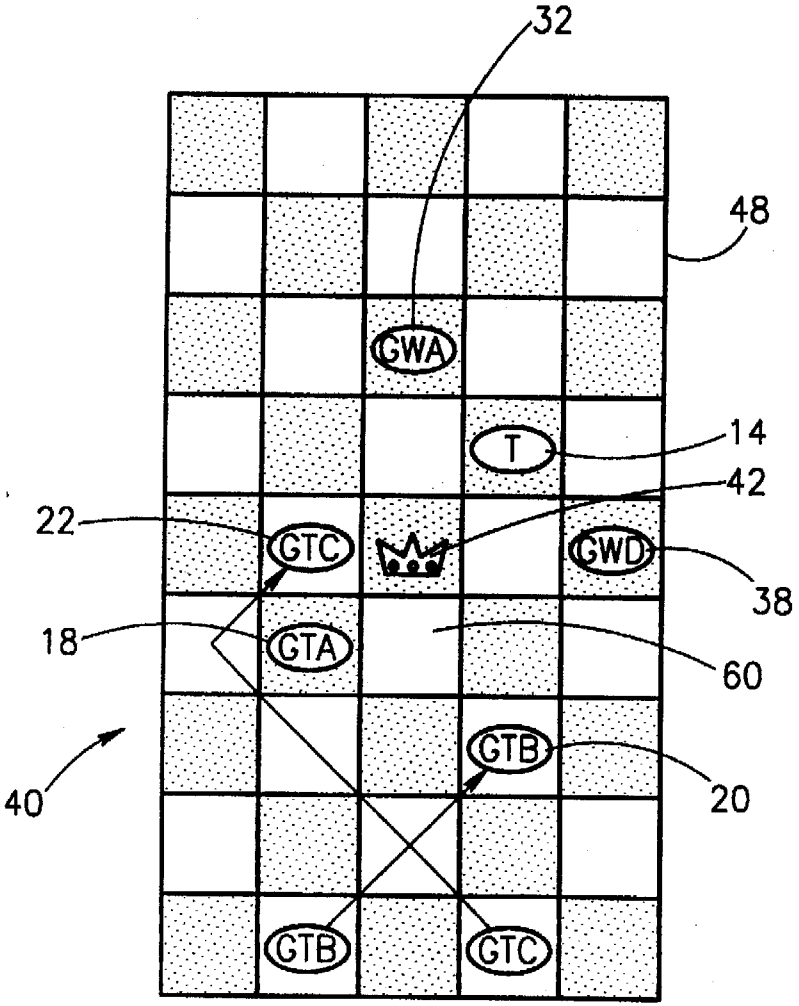
FIG. 4 is a schematic diagram illustrating three examples of a squeeze permitted during the course of play in the board game of the present invention.

A schematic diagram illustrating three examples of a squeeze permitted during the course of play in the board game 40 of the present invention is shown in FIG. 4. The first example squeeze is held by guards GTB 20 and GTC 22. Guard GTB 20 is shown having made a single jump move from its base position. Similarly, guard GTC 22 made a double jump move from its base position. The result of the squeeze is that an opponent (i.e., the warlord) is not permitted to place a piece in the square referenced 60.

The second example squeeze is held by the trumpeter T 14 and guard GTA 18 over the crown square. The third squeeze is held by guards GWA 32 and GWD 38. This third squeeze forces the trumpeter T 14 to move out of the squeezed square.

As described previously, a primary playing piece or a guard trapped in a squeeze must immediately move from the squeezed square. However, if the squeezed playing piece is a guard, and the partner of the squeezed guard is free, the squeeze can be balanced by moving the free guard diagonally along side one of the squeezing opponent's guards. Thus, the strength of a squeeze may be balanced and the squeeze is brought to what is termed a royal squeeze. In order to maintain a royal squeeze, once declared, none of the four playing pieces can move.

Both primary pieces (i.e., the trumpeter and the warlord) can participate equally in all strategic moves. Each player uses his/her playing pieces to create both squeezes and royal squeezes. Note that both squeezes and royal squeezes must be declared out loud.

Figure 5:
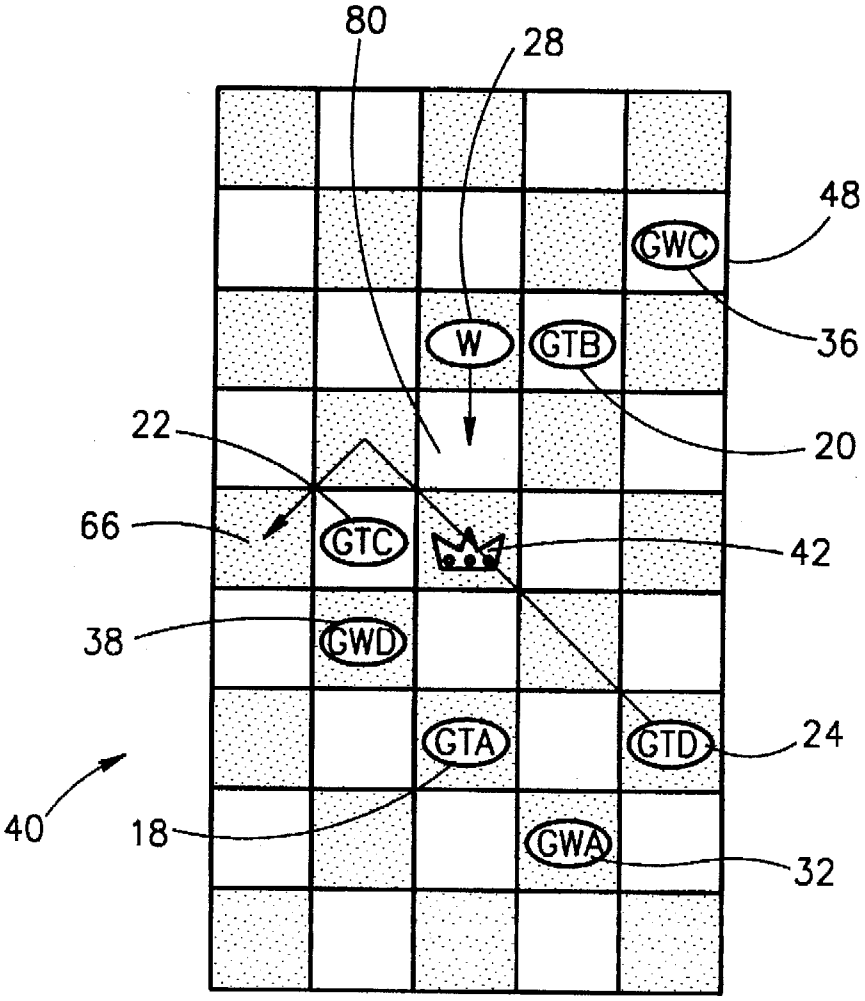
FIG. 5 is a schematic diagram illustrating two royal squeeze examples permitted during the course of play in the board game of the present invention.

A schematic diagram illustrating two royal squeeze examples permitted during the course of play in the board game of the present invention is shown in FIG. 5. In the first example, guards GWA 32 and GWD 38 hold a squeeze and are forcing guard GTA 18 out of its square. However, guard GTD 24 can make a double jump move as shown in FIG. 5 to balance the squeeze thus creating a royal squeeze.

In the second example, the warlord W 28 is permitted to move into square 80 despite that squeeze held by opponent guards GTC 22 and GTB 20, since guard GWC 36 provides the warlord W 28 adequate royal squeeze support.

Figure 6:
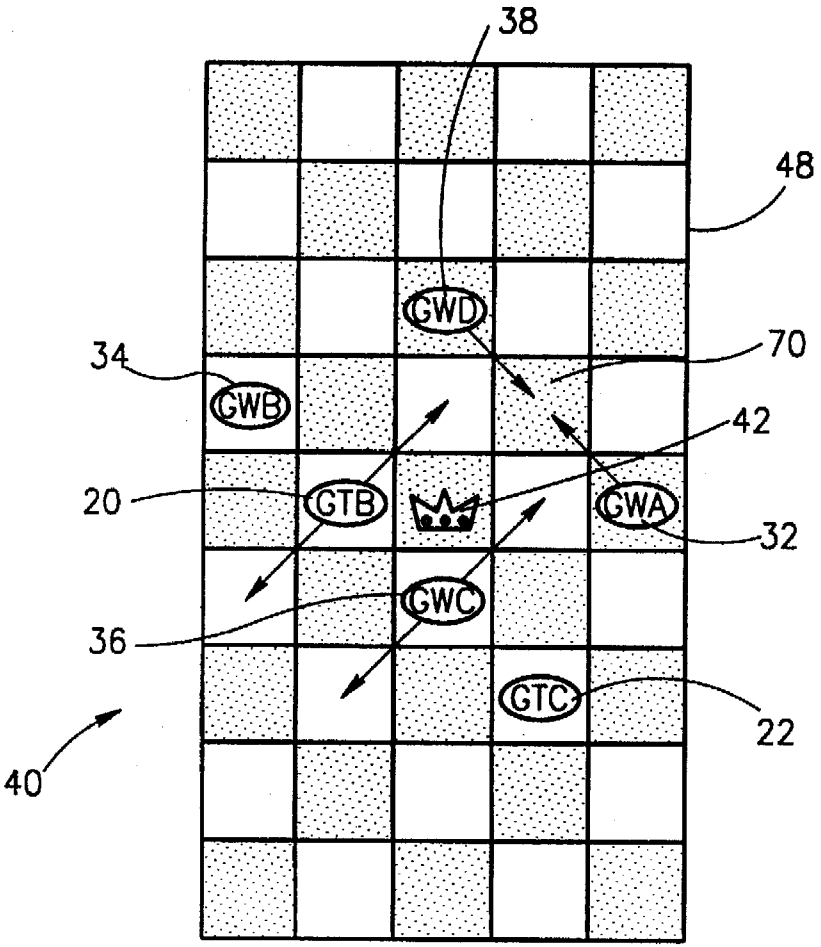
FIG. 6 is a schematic diagram illustrating the breaking of a royal squeeze.

Royal squeezes are not required to be held forever. A player desiring to break or end a royal squeeze must move his/her inner playing piece out of the royal squeeze. A schematic diagram illustrating the breaking of a royal squeeze is shown in FIG. 6. Guard GWB 34, guard GTB 20, guard GWC 36 and guard GTC 22 are in position forming a royal squeeze. Either player can break the royal squeeze. For the trumpeter side to break the squeeze, guard GTB 20 must be moved in the direction of the dashed arrows as shown in the Figure. The warlord side can also break the royal squeeze by moving guard GWC 36 in the direction of the dashed arrow as shown in the Figure.

The royal squeeze cannot be broken by moving guard GWB 34 or guard GTC 22. If guard GWB 34 is moved, a squeeze remains among guards GTB20, GWC 36 and GTC 22. Similarly, if guard GTC 22 is moved, a squeeze remains between guards GWB 34, GTB 20 and GWC 36.

An additional rule is that once a player sets two playing pieces to hold a squeeze, they are not permitted to close or shut the squeeze. In other words once a squeeze is set, a player cannot move one piece in towards the other. This rule is illustrated in FIG. 6 whereby guards GWD 38 and GWA 32 hold a squeeze. Once the squeeze is set, neither of these two guards can move into the square 70 between them. However, two playing pieces may stand diagonally side by side (i.e., in squares diagonally adjacent to each other) if they did not move into that position directly after holding a squeeze.

To eliminate endless loops during game play where players oscillate back and forth making the same moves, once a player moves a playing piece off a square, that player is not permitted to move it back to where it was, during his/her next turn.

Another rule is that a guard that is trapped in a squeeze, blocked from all sides and is prevented from receiving help from his partner is removed from the game. A guard's partner is the second guard that moves on the same colored squares as the squeezed guard, as described previously. A guard helps his/her partner by providing royal squeeze support. If the partner of the squeezed guard, who is trapped from moving, cannot provide royal squeeze support, the squeezed guard is removed from the game. Removing a guard counts as a turn. The removal of a playing piece from the game is usually a rare occurrence.

If a player, at his/her turn, suddenly discovers one of his/her opponent's playing pieces positioned in a squeezed square, and the squeeze was created previously (i.e., not during the current move), the discovering player is entitled to take the opponent's squeezed playing piece and place it anywhere he/she desires on the board. This is in addition to the discovering player taking his/her regular turn.

In addition, if a primary piece (i.e., the trumpeter or the warlord) is held in a squeeze without the ability to move, that player will be frozen and not permitted to play until his/her opponent releases them from the squeeze. The freezing of a player during game play is also rare and does not occur often.

Figure 7:
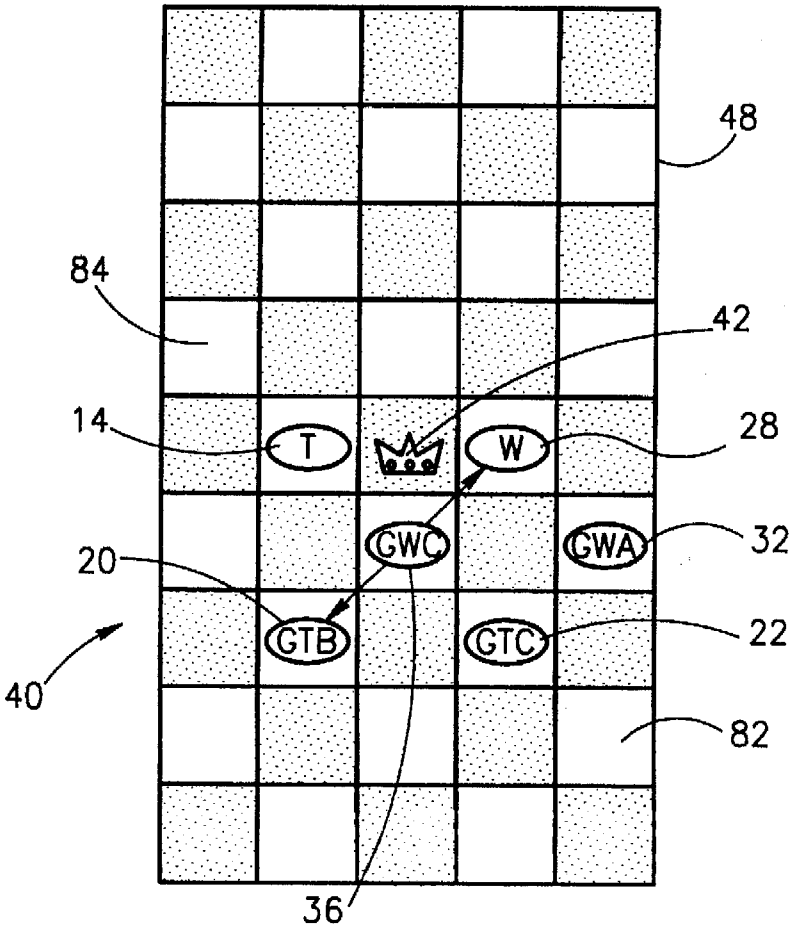
FIG. 7 is a schematic diagram illustrating the circumstances when a playing piece may be taken out of the board game of the present invention.

A schematic diagram illustrating the circumstances when a playing piece may be removed from the board game of the present invention is shown in FIG. 7. Guard GTC 22 and the trumpeter T 14 are shown holding a squeeze against guard DWC 36. To get out of the squeeze guard GWC 36 must move in the direction of either of the dashed arrows. However, both these paths are blocked by guards GTB 20 and the warlord 28. In addition, the partner guard of guard GWC 36, guard GWA 32, is not able to move into either of square 82 or square 84 to bring the squeeze to a royal squeeze. Therefore, guard GWC 36 is removed from the game. The removal of guard GWC 36 counts as a turn.

Suggested Strategy

The following section discusses several points of strategy for players to keep in mind while the board game of the present invention. The first is if one player opens the game by moving a guard that moves along corridors, it is advisable the his/her opponent also open with a corridor guard. Otherwise, both the opponent's corridor guards may be blocked during the other player's next move.

Foreseeing a few steps ahead of the current turn can be quite helpful and goes a long way towards developing a successful strategy. In fact, the board game of the present invention may help develop skills useful in playing other strategic games such as chess.

One of the most important suggestions is to block an opponent's primary piece from progressing towards the princess (i.e., the conquest square).

In an alternative embodiment, the board game of the present invention can be played by more than two players. Each player has a primary playing piece and an even number of secondary playing pieces. To ease crowding on the game board, the game board can be increased to larger dimensions while maintaining the conquest square in the center square.

Figure 8:
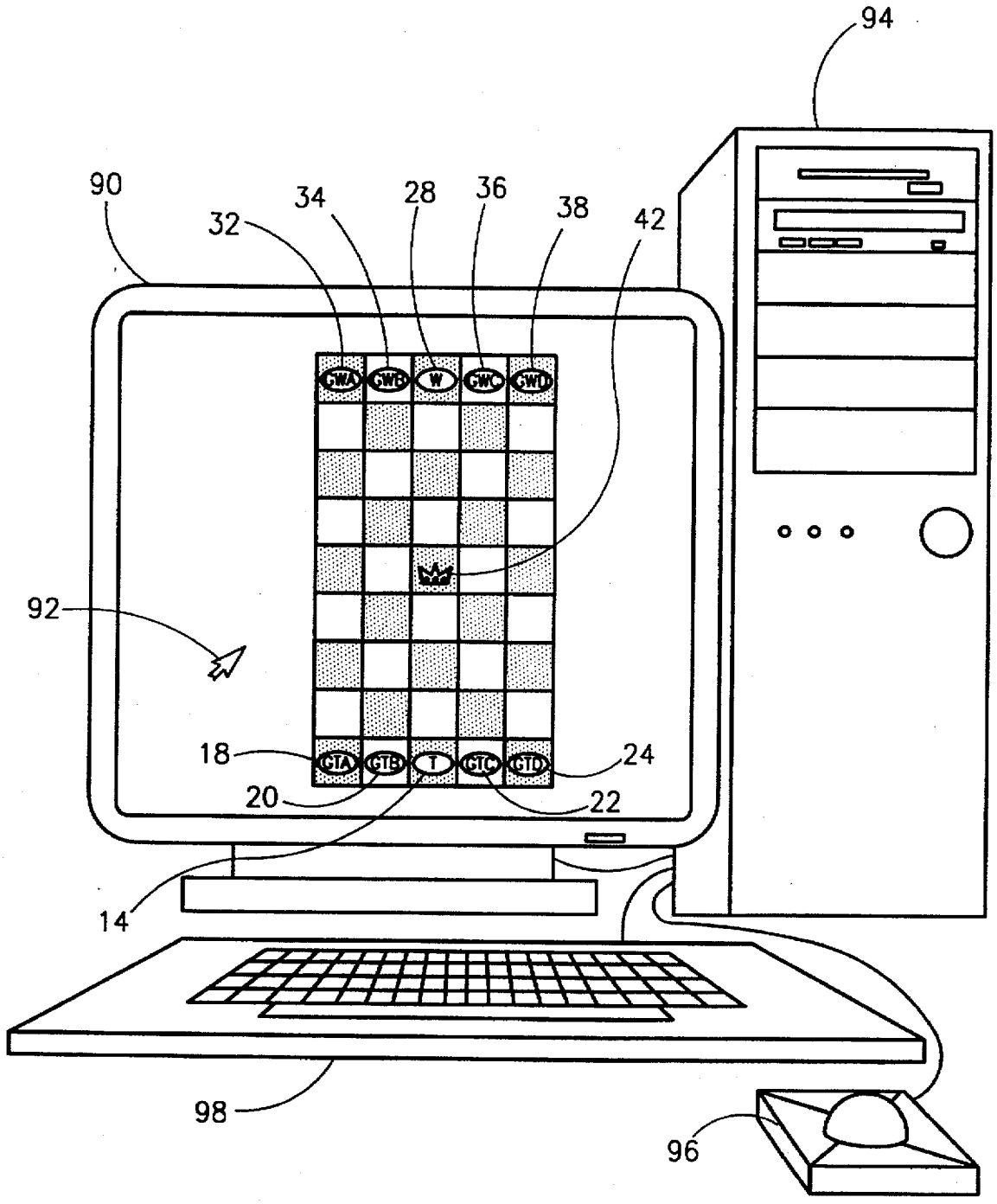
FIG. 8 is an illustration of the board game of the present invention adapted to be played on a computer.

The board game and method of play thereof taught by the present invention can be adapted to be played on a computer. A computer and its basic constituent parts are illustrated in FIG. 8. The computer comprises a main processing unit 94 which houses the processor, memory and disk storage devices. Coupled to the computer is a display 90, keyboard 98 and pointing device 96. Displayed on display 90 is the board game of the present invention at the beginning of play. Players utilize the pointing device 96 to manipulate a cursor 92 to move playing pieces around on the playing surface simulated by the computer.

The computer can function in of two modes. In the first mode, the computer serves as a referee only, functioning to verify and display player's moves on a display screen. This mode of operation is termed referee mode.

Alternatively, the computer can perform in the role of a player. This mode is termed player mode. Using the rules of the game and the movement of the playing pieces as described above, one smiled in the art can construct a suitable computer program to allow a computer to play the board game of the present invention in either referee mode or player mode.

While the invention has been described with respect to a limited number of embodiments, it will be appreciated that many variations, modifications and other applications of the invention may be made.

What is claimed is:

1. A board game playable by two players, comprising:

a game board having a checkerboard playing surface, said playing surface having a plurality of squares, said plurality of squares alternating light and dark in color and arranged in adjacent horizontal rows and vertical columns, said playing surface having a conquest square located in the center thereof, the number of horizontal rows being greater than the number of vertical columns, said game board having a first horizontal end row and a second horizontal end row;

a first set of playing pieces and a second set of playing pieces, each set of playing pieces including at least one primary playing piece and an even, as opposed to odd, number of secondary playing pieces, said secondary playing pieces visually distinguishable from said at least one primary playing piece;

wherein said first and said second set of playing pieces visually distinguishable from each other; and wherein said first set of playing pieces initially located in said first horizontal end row, said second set of playing pieces initially located in said second horizontal end row.

2. The board game according to claim 1, wherein said playing surface of said board game comprises an odd number of horizontal rows and vertical columns.

3. The board game according to claim 1, wherein said playing surface of said board game comprises an array of said squares arranged nine horizontal rows by five vertical columns.

4. The board game according to claim 1, wherein said light squares of said playing surface represent corridors of a palace.

5. The board game according to claim 1, wherein said dark squares of said playing surface represent rooms of a palace.

6. The board game according to claim 1, wherein said conquest square represents a room occupied by a princess.

7. The board game according to claim 1, wherein said first set of playing pieces comprises one primary playing piece and four secondary playing pieces.

8. The board game according to claim 1, wherein said second set of playing pieces comprises one primary playing piece and four secondary playing pieces.

9. The board game according to claim 1, wherein said first set of playing pieces comprises a trumpeter and four guards.

10. The board game according to claim 1, wherein said second set of playing pieces comprises a warlord and four guards.

11. The board game according to claim 1, wherein a player moves their said primary playing pieces and said secondary playing pieces so as to apply a squeeze to a particular square, said squeeze effective to prevent an opponent playing piece from entering said particular square and, if said particular square is already occupied by said opponent playing piece, forcing said opponent playing piece to move from said particular square.

12. The board game according to claim 11, wherein a player can break said squeeze by moving either a primary or secondary playing piece into position so as to bring said squeeze to a royal squeeze.

* * * * *